US008777049B2

(12) United States Patent
Weiss et al.

(10) Patent No.: US 8,777,049 B2
(45) **Date of Patent: *Jul. 15, 2014**

(54) LID HAVING CIRCUMFERENTIAL RIM WITH PLURALITY OF RIBS

(71) Applicants: David Weiss, Plantation, FL (US); Martin Pechter, Boca Raton, FL (US); Thomas W. Talbot, Plantation, FL (US)

(72) Inventors: David Weiss, Plantation, FL (US); Martin Pechter, Boca Raton, FL (US); Thomas W. Talbot, Plantation, FL (US)

(73) Assignee: uVu Technologies, LLC, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/872,586

(22) Filed: Apr. 29, 2013

(65) Prior Publication Data

US 2013/0248544 A1 Sep. 26, 2013

Related U.S. Application Data

(63) Continuation of application No. 12/788,656, filed on May 27, 2010, now Pat. No. 8,430,268.

(51) Int. Cl.
*A47G 19/22* (2006.01)

(52) U.S. Cl.
USPC ..... 220/717; 220/713; 220/781; 220/367.1; 206/508

(58) Field of Classification Search
CPC ..... B65D 21/0222; B65D 39/02; B65D 2251/04; B65D 2543/00416; B65D 2543/00629; B65D 2543/00046; B65D 2543/00731; B65D 2543/00092; B65D 43/0212; B65D 2543/00537; B65D 2543/00509; B65D 2543/00555; B65D 2543/00296; B65D 2543/00685
USPC ..... 220/717, 790, 780, 367.1, 713, 782, 220/789, 781, 792, 802; 206/508; 215/387–389
See application file for complete search history.

(56) References Cited

U.S. PATENT DOCUMENTS

| | | | |
|---|---|---|---|
| 3,679,088 | A | 7/1972 | Swett et al. |
| 3,722,784 | A | 3/1973 | Harper |
| 3,860,162 | A | 1/1975 | Schutz |
| 4,146,157 | A | 3/1979 | Dixon et al. |

(Continued)

OTHER PUBLICATIONS

Documents presented at PTO Interview with Examiner on Jan. 22, 2013 identified as: Exhibit A (draft claim amendments to independent claims 1, 27 and 28, 3 pages).

(Continued)

*Primary Examiner* — Fenn Mathew
*Assistant Examiner* — James N Smalley
(74) *Attorney, Agent, or Firm* — Fox Rothschild LLP

(57) ABSTRACT

A lid for securing to the brim of a container, the lid including a container closure having a disk shaped member with a periphery for mating with the brim of the container. The periphery includes annular inner and outer side walls with at least one annular rib disposed on each of the inner and outer side walls. The ribs of the annular walls form a gripping area to secure the lid to the container for preventing leaks and accidental spillage. A top wall interconnects the inner and outer side walls and includes visual cues for viewing the brim of the container when the lid is affixed to the brim. The lid additionally includes a pronounced wedge shaped sipping spout projecting upwards from the container closure. The container closure includes a circular indented channel for stacking one lid covered cup over another with additional stability provided by the sipping spout.

17 Claims, 8 Drawing Sheets

(56) References Cited

U.S. PATENT DOCUMENTS

| | | | | |
|---|---|---|---|---|
| 4,245,752 | A | 1/1981 | Prueher | |
| 4,438,865 | A | 3/1984 | Scattaregia | |
| 4,627,537 | A | 12/1986 | Rogers | |
| 4,640,435 | A | 2/1987 | Dutt | |
| 4,756,440 | A | 7/1988 | Gartner | |
| 5,076,425 | A | 12/1991 | Plone | |
| 5,086,956 | A | 2/1992 | Polhemus | |
| 5,377,860 | A | 1/1995 | Littlejohn et al. | |
| 5,511,680 | A | 4/1996 | Kinne | |
| 5,538,157 | A * | 7/1996 | Proshan | 220/717 |
| 5,871,118 | A | 2/1999 | Franzese | |
| 5,875,915 | A | 3/1999 | Bradshaw et al. | |
| 5,894,952 | A | 4/1999 | Mendenhall et al. | |
| D417,845 | S | 12/1999 | Sadlier et al. | |
| 6,168,044 | B1 | 1/2001 | Zettle et al. | |
| 6,207,100 | B1 | 3/2001 | Weiss et al. | |
| 6,230,924 | B1 | 5/2001 | Weiss et al. | |
| 6,419,112 | B1 | 7/2002 | Bruce et al. | |
| 6,488,170 | B1 | 12/2002 | Johnson | |
| D468,206 | S | 1/2003 | Weiss et al. | |
| D469,693 | S | 2/2003 | Weiss et al. | |
| D476,567 | S | 7/2003 | Weiss et al. | |
| 6,679,397 | B2 | 1/2004 | Smith et al. | |
| 6,688,487 | B2 | 2/2004 | Oakes et al. | |
| 6,883,677 | B2 | 4/2005 | Goeking et al. | |
| 6,976,604 | B2 | 12/2005 | Connors, Jr. et al. | |
| 7,055,715 | B2 | 6/2006 | Maravich et al. | |
| 7,063,231 | B2 | 6/2006 | Stanos et al. | |
| 7,318,536 | B2 | 1/2008 | Maravich et al. | |
| 7,591,393 | B2 | 9/2009 | Crudgington, Jr. | |
| D609,046 | S | 2/2010 | Valderrama et al. | |
| 8,074,831 | B2 | 12/2011 | Walker et al. | |
| 8,091,732 | B2 | 1/2012 | Byson et al. | |
| 2002/0020708 | A1* | 2/2002 | Weiss et al. | 220/366.1 |
| 2007/0007298 | A1* | 1/2007 | Tucker et al. | 220/791 |
| 2007/0045316 | A1 | 3/2007 | Arnljots | |
| 2008/0203096 | A1* | 8/2008 | Maxwell | 220/374 |

OTHER PUBLICATIONS

Documents presented at PTO Interview with Examiner on Jan. 22, 2013 identified as Exhibit B (drawing excerpts from Stanos and Weiss references, 1 page).

Documents presented at PTO Interview with Examiner on Feb. 21, 2012 identified as Exhibit C (PowerPoint presentation describing cited prior art, 56 pages).

Demonstrative Exhibit presented at PTO Interview with Examiner on Feb. 21, 2012 identified as Exhibit D (List of Exemplar Lids, 1 Page).

* cited by examiner

FIG. 3
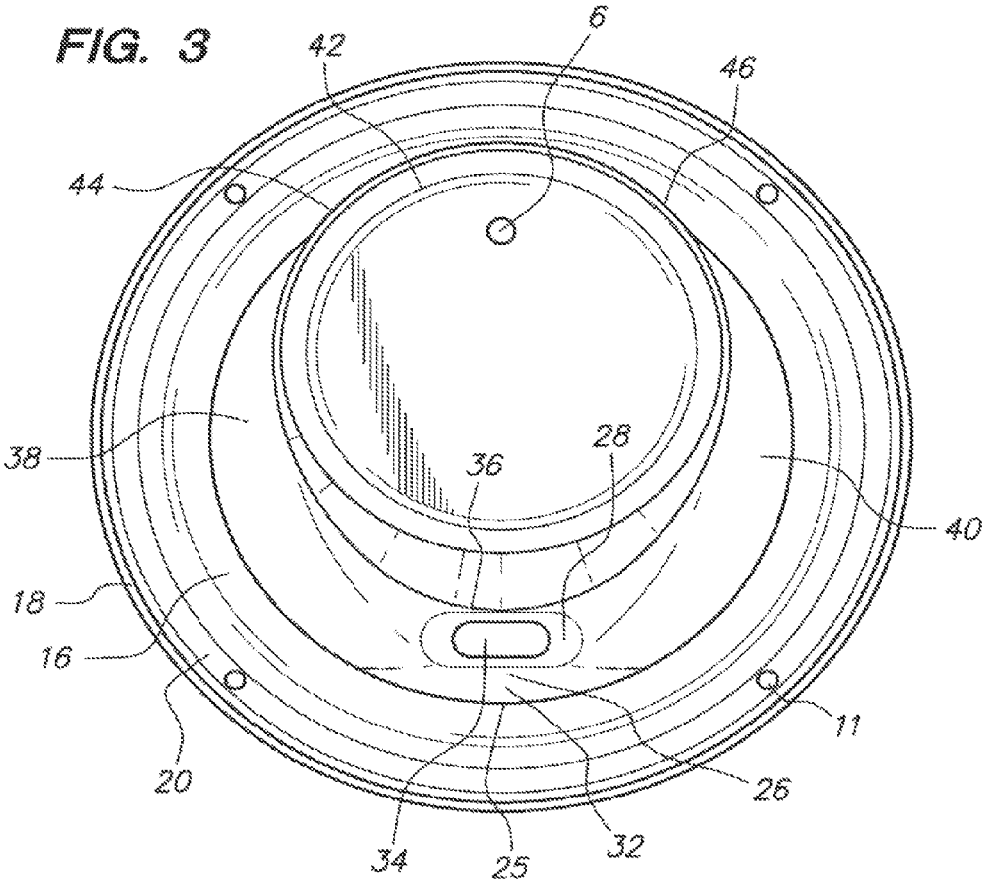
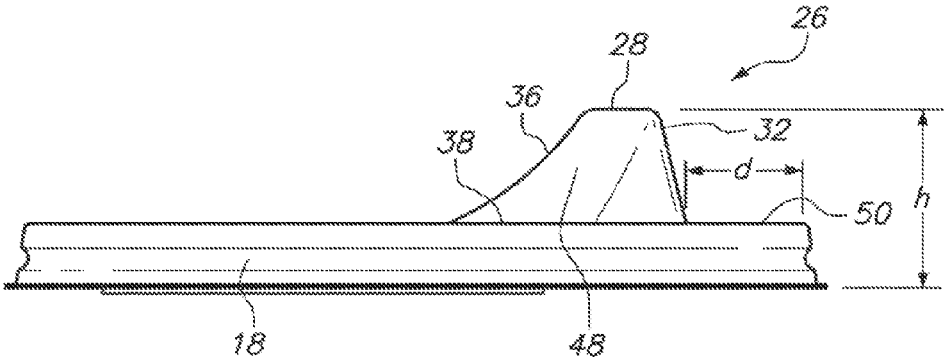
FIG. 4

FIG. 7A
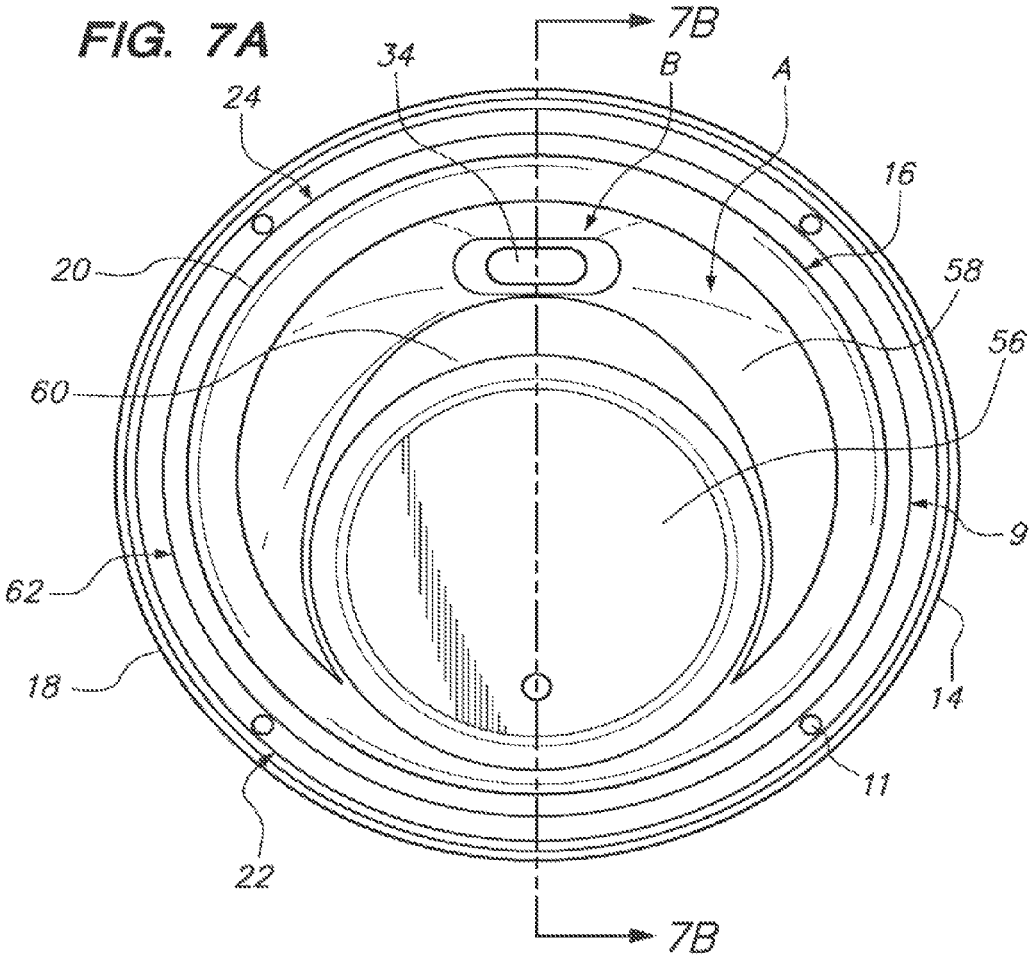
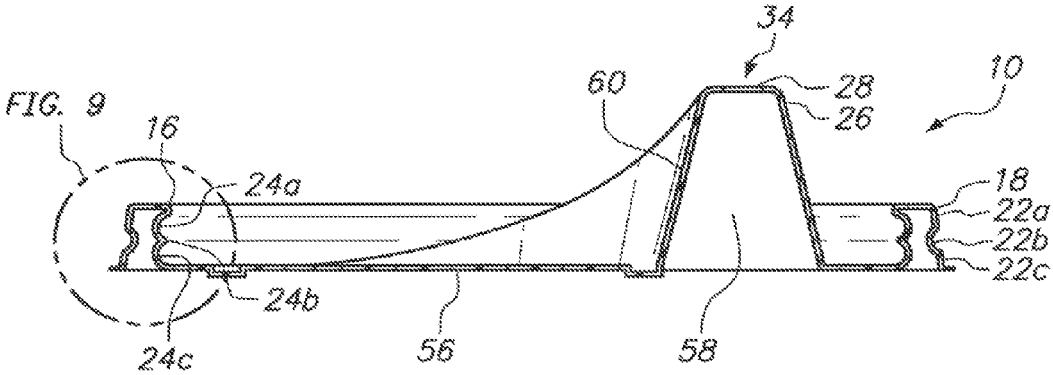
FIG. 7B

LID HAVING CIRCUMFERENTIAL RIM WITH PLURALITY OF RIBS

This application is a continuation of U.S. patent application Ser. No. 12/788,656 filed on May 27, 2010, and issued as U.S. Pat. No. 8,430,268 on Apr. 30, 2013.

BACKGROUND OF THE INVENTION

Field of the Invention

The present disclosure relates generally to a lid for a disposable container. More particularly, the present invention is directed to a lid having double parallel inner ribs for superior no leak sealing, an outer side wall lid gripping feature for additional protection against accidental spilling, a pronounced elevated sipping spout and a circular indented channel on top of the lid, allowing for stacking a beverage container over another lid covered container, with additional stability provided by the curved rear surface of the sipping spout.

Prior art disposable lids are known in the art. Generally, the lids are made from a thermoplastic molded or pressed member and are disk shaped. Generally at a proximal location of the disk shaped member, the lid will include an aperture for drawing liquid from the container, which is connected to the lid. Lids known in the art include an annular rim that fastens onto the periphery of a beverage container. However, the prior art lids are often deficient in that if applied in haste or if the container is bent it is easy to include a slight gap or tolerance defined between the periphery of the annular rim and the periphery of the beverage container. Once a user picks up the beverage container and attempts to drink from the container, the lid may become separated from the container and spillage may occur. Also, it is often difficult to quickly and accurately assess whether the lid is properly secured to the beverage container. In addition, the gap or tolerance between the periphery and rim will likely cause the lid to become completely dislodged from the container in the event a user accidentally spills the container, resulting in spillage of the contents therein. Thus, lids known in the art do not achieve a satisfactory sealing or fastening arrangement with the rim of a beverage container and are therefore prone to contributing to accidental spillage and leaking.

Also, when stacked, generally one on top of another, the stacked lids tend to become unstable and may fall to the ground. This causes a problem as the fall can cause the lids to become unsanitary and soiled. A beverage provider will generally throw the soiled lids, causing unnecessary waste.

If the lid includes an aperture that is defined too close to the annular wall of the lid, or to the proximal most location of the lid, the user's bottom lip will contact an irregular surface of the lid to draw from the aperture. Thus, this creates a poor surface from which to draw liquid and further promotes accidental spillage.

Finally, it is advantageous to stack multiple lid covered beverage containers on top of one another. However, the lids known in the art do not allow such usage without a high risk that the containers will topple.

Thus, there is a need for an improved lid that obviates these risks and overcomes other deficiencies in the prior art.

SUMMARY OF THE INVENTION

As described herein, the various exemplary embodiments of the present invention overcome one or more of the above or other disadvantages known in the art.

One aspect of the present disclosure relates to a lid for a container. The lid comprises a container closure for securing to the brim of a beverage container. The container closure portion comprises a circular shaped disk member including a circumferential rim extending about a periphery of the container closure. The circumferential rim of the periphery of the circular shaped disk mates with the brim of the beverage container for sealing engagement therewith.

The circumferential rim includes an annular outer side wall, an annular inner side wall and an annular top wall, interconnecting the outer side wall and the inner side wall. The outer side wall is disposed opposite to the inner wall and is contiguous to the top wall. The annular side wall and the annular inner wall include at least one annular rib each.

In one aspect of the invention, the annular inner wall includes two parallel annular ribs disposed inwardly along an interior circumference of the inner wall and the annular outer side wall includes an annular rib disposed opposite and parallel to the annular ribs of the inner wall.

Thus, when the lid is used in conjunction with a beverage container, the annular ribs of the inner side wall and the outer side wall each form a gripping area to secure the lid to the brim of a beverage container in a sealing engagement therewith to prevent leaking and accidental spillage.

In another aspect of the invention, the annular top wall includes a plurality of spaced openings or visual cues. The openings or visual cues provide for viewing of the brim of the beverage container over each quadrant of the lid when the lid is attached to the brim of the container. In this manner, when the lid is affixed to the brim, visual inspection of the lid with respect to the container is readily apparent and the structural integrity of the fastened lid in conjunction with the container can be assessed.

Thus, when the lid is positioned about the brim of the container and secured thereto by further pressing on the openings to affix the lid to the brim of the container, it will be possible to visually inspect that the lid is properly positioned and secured to the brim of the container. A secure fit of lid to container can therefore be achieved by pressing on the openings.

In yet another aspect of the invention, the lid includes a sipping spout spaced from a proximal most location of the lid and projecting upwards and extending from the container closure. The sipping spout comprises an aperture disposed on top of the spout. The sipping spout further comprises a base that is integral with the circular shaped disk. The base of the sipping spout has a width that is generally greater than the width of the top of the sipping spout.

The sipping spout is elevated and elongated and extends from a top side of the lid and further provides for an improved spout for drawing liquid from the container. Even more particularly, the present spout includes a rear surface with a curvature that is the same curvature as a container and allows a second beverage container to be stacked on the lid and supported by the rear surface.

A circular indented channel on the top of the container closure acts as a stiffening member and allows for stacking one lid covered cup over another with additional stability provided by the curved rear surface of the sipping spout.

According to yet another aspect there is provided a lid for fastening to a first beverage container rim. The lid comprises at least two support surfaces for receiving a second beverage container in a stacked configuration on a top of the lid opposite the first beverage container.

These and other aspects and advantages of the present disclosure will become apparent from the following detailed description of preferred embodiments of the invention considered in conjunction with the accompanying drawings, in which like drawings represent like components. It is to be understood, however, that the drawings are designed solely for purposes of illustration and not as a definition of the limits of the disclosure, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

FIG. 3 is top view of the lid of FIG. 1.

FIG. 4 shows a lateral side view of the lid of FIG. 1.

FIG. 7A shows a bottom view of the lid of FIG. 1.

FIG. 7B shows a cross sectional view of the lid of FIG. 7A along line 7*b*-7*b* of FIG. 7A.

DETAILED DESCRIPTION OF THE EXEMPLARY EMBODIMENTS

It is contemplated that the teaching of the description set forth below is applicable to all types of packaging, including but not limited to disposable beverage cup containers made from styrofoam, compostable plastic or polymer material, thermoplastic, paper for coffee, tea, soda or other suitable material, as is readily appreciated by one skilled in the art. The present disclosure is therefore not intended to be limited to any particular container apparatus or configuration described in the exemplary embodiments of the present disclosure. It should be appreciated that the present invention may also be applicable to other types of containers and cups that are non-disposable, such as, for example, a vacuum sealed travel coffee cup.

Figure 1:
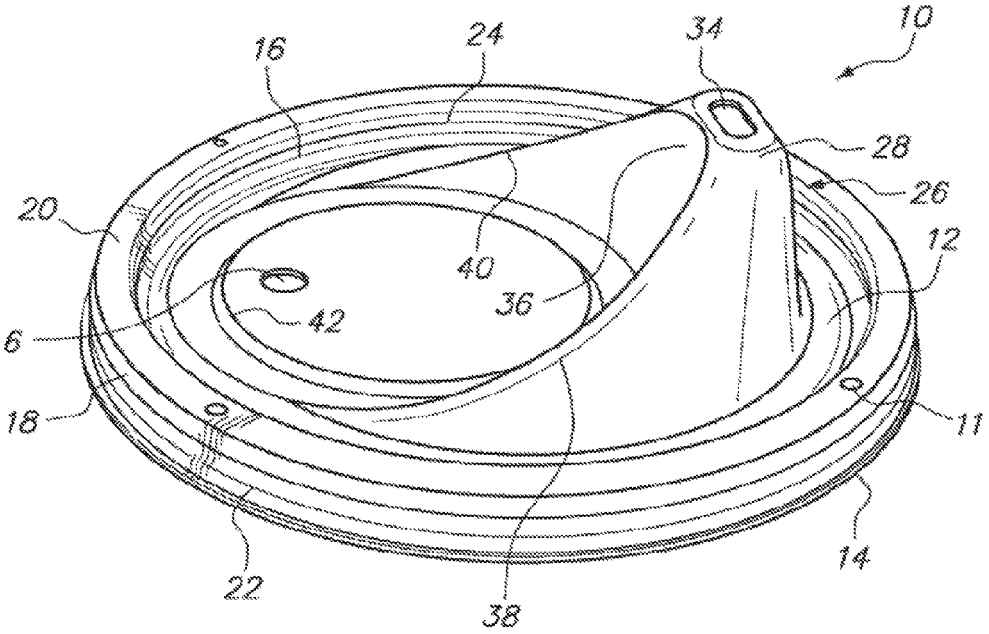
FIG. 1 is a perspective view of a lid including a wedged shaped sipping spout according to an exemplary embodiment of the present disclosure.

FIG. 1 illustrates an exterior view of a lid 10 according to an embodiment of the present invention. The lid 10 may be composed of recyclable material such as PET, PETR, polypropylene, polystyrene, polyethylene or other suitable material. The lid 10 includes a container closure 12. Container closure 12 is preferably a disk shaped member made from a moldable or stamped material and includes a circumferential rim extending about a periphery 14 of the container closure 12. The circumferential rim of the periphery 14 of the circular shaped disk mates with the brim 7 of the beverage container 5 (shown in FIG. 12) for sealing engagement therewith.

In a preferred embodiment, the circumferential periphery 14 includes annular walls 16, 18, 20 for mating with the brim 7 of the beverage container 5.

Referring now to FIGS. 1, 3, 5, 7A and 10, a raised annular inner side wall 16 and a raised annular outer side wall 18 extend around the periphery 14 of the lid 10. Further, the annular outer side wall 18 extends around the annular inner wall 16. Annular outer side wall 18 is generally parallel to and opposite the annular inner side wall 16. Annular walls 18 and 16 are interconnected by an annular top wall 20 which is generally perpendicular to walls 16 and 18.

Disposed on the annular inner side wall 16 are one or more annular ribs 24. The ribs 24 extend along an inner circumference of the inner wall 9 of the periphery 14 of lid 10 (shown in FIGS. 7A and 8). Disposed on the annular outer side wall 18 are one or more annular ribs 22 extending along an inner periphery 63 of lid 10 (shown in FIG. 8). Preferably, ribs 24 are parallel to ribs 22.

FIG. 7A, illustrates a bottom view of the lid 10. Outer side wall 18, top wall 20 and inner side wall 16 extend along periphery 14 of the lid 10 and form a channel 62 therein. Channel 62 preferably is sized to fit the brim 7 of the conventional beverage container 5 (shown in FIG. 12). In a preferred embodiment, channel 62 includes an arrangement of one or more parallel ribs 22, 24 disposed on annular outer side wall 18 and annular inner side wall 16 to grip the rim 7 of the beverage container 5.

In a preferred embodiment, the annular inner wall 16 includes two parallel ribs 24 disposed inwardly along an inner circumference of the inner wall 9 and the annular outer side wall 18 includes one annular rib 22 disposed opposite and generally parallel to annular ribs 24 of the inner side wall 16. Ribs 24 and 22 on inner side wall 16 and outer side wall 18 thereby form a gripping area to secure the lid 10 to the brim 7 of a beverage container 5 for a sealed mating configuration between the lid 10 and the container 5.

Figure 8:
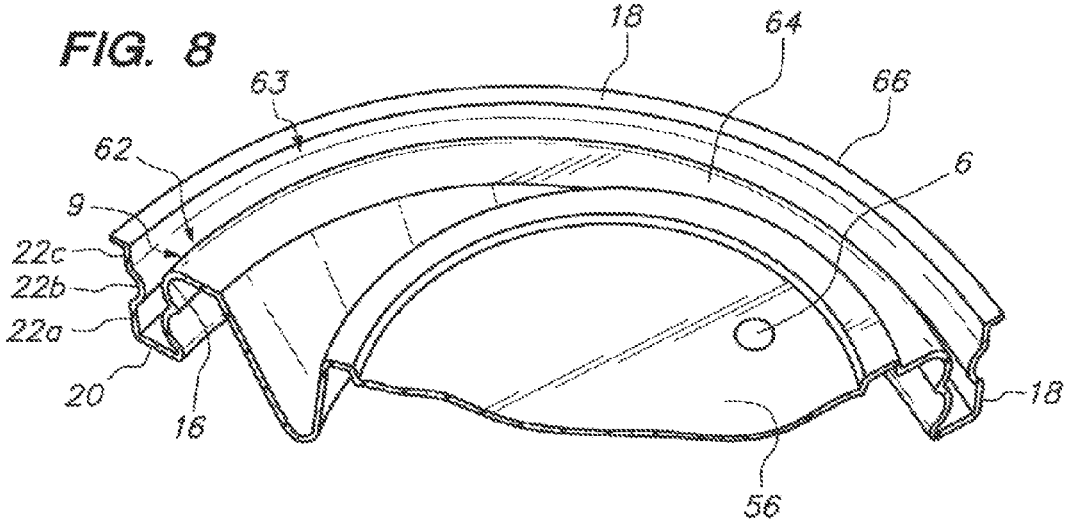
FIG. 8 shows a close up view of a bottom surface of the lid comprising an annular outer side wall, an annular top wall, and an annular inner side wall with the walls comprising a channel.
Figure 8A:
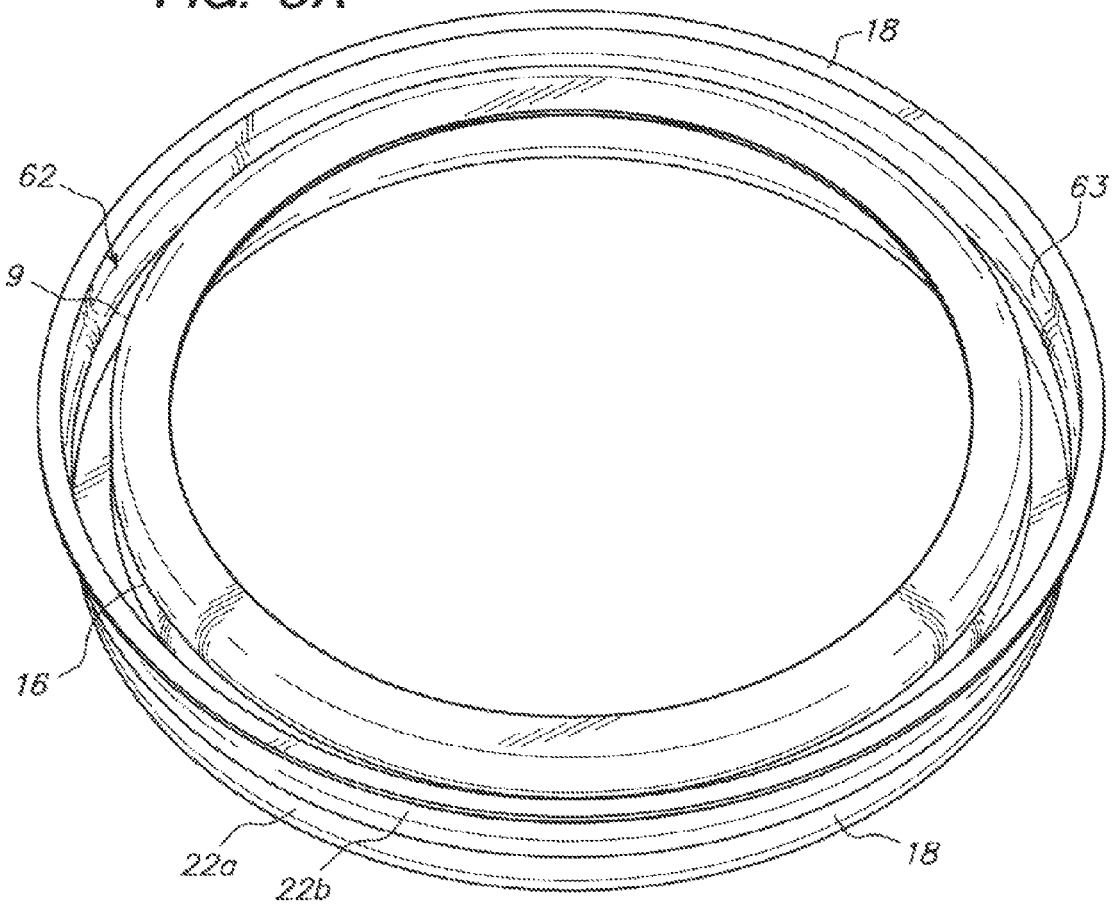
FIG. 8A is a view directed to the circumferential rim of the lid of the present invention taken from the underside.

FIG. 8 shows a close up view of a bottom surface 56 of the lid 10 comprising an annular outer side wall 18, an annular top wall 20, and an annular inner side wall 16 with the walls 18, 16 and 20 comprising a channel 62.

Annular outer side wall 18 is disposed a relative distance from the annular inner side wall 16 with rib 22*b* being shown on an inner surface 63 of the annular outer side wall 18. Annular rib 22*b* extends around the outer side wall 18. As can be seen, rib 22*b* includes a profile that is shaped from a top of rib element 22*c* to a bottom of channel 22*a* Annular rib element 22*c* extends around the annular side wall 18, and is parallel to and spaced from channel 22*a* Annular channel 22*a* and rib element 22*c* are formed intermediate relative to rib 22*b*. Preferably, rib 22*b* and rib element 22*c* provide a sealing surface for the brim 7 of the beverage container 5 whereby the brim of the beverage container is secured along channel 22*a* between the top annular wall 20 and the upper portion of rib 22*b* for sealing engagement with the exterior portion of the brim 7 of a beverage container 5.

Figure 9:
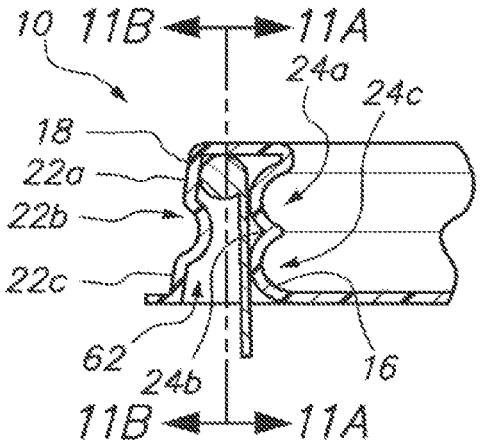
FIG. 9 shows a cross sectional view of the annular outer side wall, the annular top wall and the annular inner side wall.

FIG. 9 shows a cross sectional view of channel 62. There is shown a cross sectional view of the annular inner wall 16 spaced from the annular side wall 18 with the channel 62 being formed therein for securing a brim 7 of a beverage container 5. The annular inner wall 16 comprises annular rib elements 24*a* and 24*c* forming a channel 24*b* therebetween. Channel 24*b* is parallel relative to the rib 22*b* formed in outer side wall 18. Therefore, the rim 7 of the beverage container 5 is directed into channel 62 and secured along both sides of the brim to ensure sealing engagement therewith. Referring to FIGS. 7B, 9, 10 and 11A, channel 24*b* retains liquid that seeps past annular rib 24*c* prior to contacting annular rib 24*a*.

The annular top wall 20 of the lid 10 includes a plurality of spaced visual cues 11. The visual cues 11 provide for viewing of the brim 7 of the beverage container 5 when the lid 10 is attached to the brim 7 of the container 5. The position of the brim 7 of the container 5 is visible through the visual cues 11 when the lid 10 is securely affixed to the container 5, such that a position of the lid 10 with respect to the brim 7 of the container 5 may be readily ascertained.

In a preferred embodiment, the lid 10 of the present invention includes four visual cues 11. Referring to FIG. 1, the four visual cues 11 are shown with respective pairs of the visual cues 11 being diametrically opposed to one another for viewing of the brim 7 over each quadrant of the lid 10. In a preferred embodiment, the visual cues 11 are openings. It is noted that any number, size and configuration of the visual cues 11 may be included so long as the visual inspection of the lid 10 with respect to the brim 7 of the container 5 is readily apparent and the structural integrity of the lid is maintained. Thus, in this manner, when the lid 10 is affixed to the brim 7, visual inspection of the lid 10 with respect to the container 5 is readily apparent and the structural integrity of the fastened lid 10 in conjunction with the container 5 can be assessed.

Figure 2:
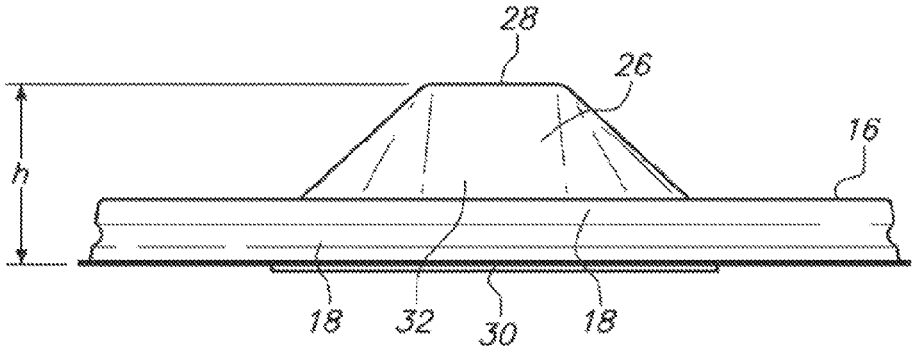
FIG. 2 is a front view of the lid of FIG. 1.

Turning now to FIG. 2, there is shown a view of the lid 10 that includes a sipping spout 26. Sipping spout 26 includes at least four lateral sides, 32, 36, 48, 52 (shown in FIGS. 3 and 5) and a top side 28 to permit a user's mouth to fit around the spout 26. Top side 28 is generally elliptically shaped and flat and includes an aperture 34 through which a fluid is conveyed from the beverage container 5 to the user. This geometry provides for an engaging configuration for a user to draw fluid from the container 5.

Preferably, the sipping spout 26 includes a top side 28 that projects upward and extends a height h from a bottom most portion 30 of lid 10. In a preferred embodiment h is generally about 1 and ⅞ inches. In a non-limiting embodiment of the present disclosure, the height of sipping spout 26 is slightly less than about twenty five percent of the diameter of lid 10. Various configurations are possible and within the scope of the present disclosure. It will be appreciated by those reasonably skilled in the art that lid 10 may include various diameters and heights h based on the type of lid 10 and beverage container.

The top side 28 is generally smaller in length than a bottom side 25 (shown in FIG. 3) of spout 26 of lid 10 so the sipping spout 26 includes a generally wedged shaped member as shown in the accompanying figures. However, in another embodiment of the present disclosure, the spout 26 may include other shapes, such as a square shape, a triangular shape, a rectangular shape or any polygonal shape known in the art.

The spout 26 preferably includes a front lateral surface 32, shown in FIG. 2, that is separately defined from the annular outer side wall 18 and is spaced a distance from walls 16 and 18 of the lid 10. In this manner, the spout 26 is spaced from a proximal most portion of the lid 10 at annular side wall 18. The distance preferably permits a user's bottom lip to grasp a lateral surface 32 without contacting the annular side wall 18 for an improved fit of a user's mouth around the spout 26. In one non-limiting embodiment, the distance may be greater than half an inch from the proximal most edge of lid 10.

Referring to FIGS. 1, 3, 4 and 5, the spout 26 includes a rear side 36. Rear side 36 is opposite to the front lateral surface 32. The sipping spout 26 further includes a first and a second base member 38 and 40 that are integral with the lateral surface 32 and the rear side 36 to give the sipping spout 26, the generally wedge shape as shown. The first base member 38 is integrated with the base container closure 12 and is generally located in a center most section of the container closure 12. Likewise, the second base member 40 is integrated with the base container 12 in mirror image to the first base member 38. The first and the second base members 38 and 40 of the spout 26 preferably are advantageous and provide a stable support to the spout 26, including the top side 28, which is spatially discrete relative to the annular outer side wall 18. Therefore, in this manner, forces imparted by the user in drinking are transmitted to the spout 26 and distributed to the centermost portion of the lid 10 and not to the annular outer side wall 18, top wall 20 or annular inner side wall 16. This location does not disturb the mating engagement between the annular outer side wall 18, inner side wall 16, top wall 20 and the periphery 14 of the beverage container 5.

Turning now to FIG. 3, there is shown a top view of the lid 10 with sipping spout 26 projecting upwards and extending from the container closure 12. As can be seen and understood from FIG. 3, the top side 28 of spout 26 includes an elliptically shaped surface that is generally flat. The top side 28 also has an aperture 34 where fluid is released from the beverage container and dispensed to the user to drink. Aperture 34 is generally shown as an elliptically shaped hole 34, however it should be appreciated by one of ordinary skill in the art that the aperture 34 may less preferably form other shapes such as, for example, circular, rectangular or the like.

Figure 5:
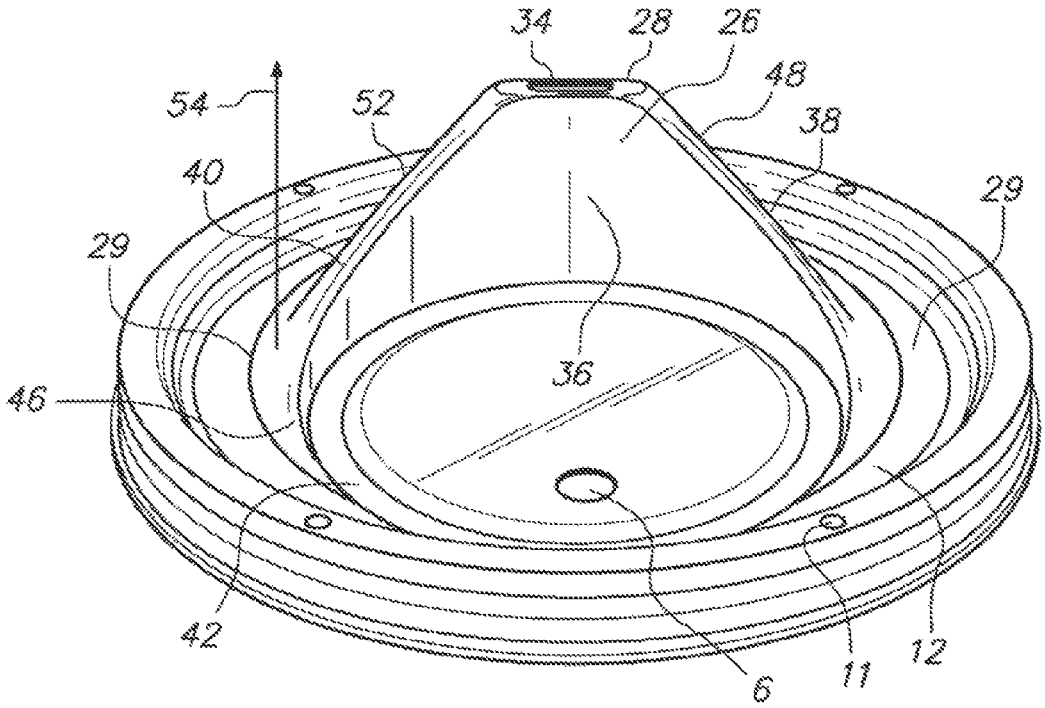
FIG. 5 shows a rear view of the lid of FIG. 4.
Figure 10:
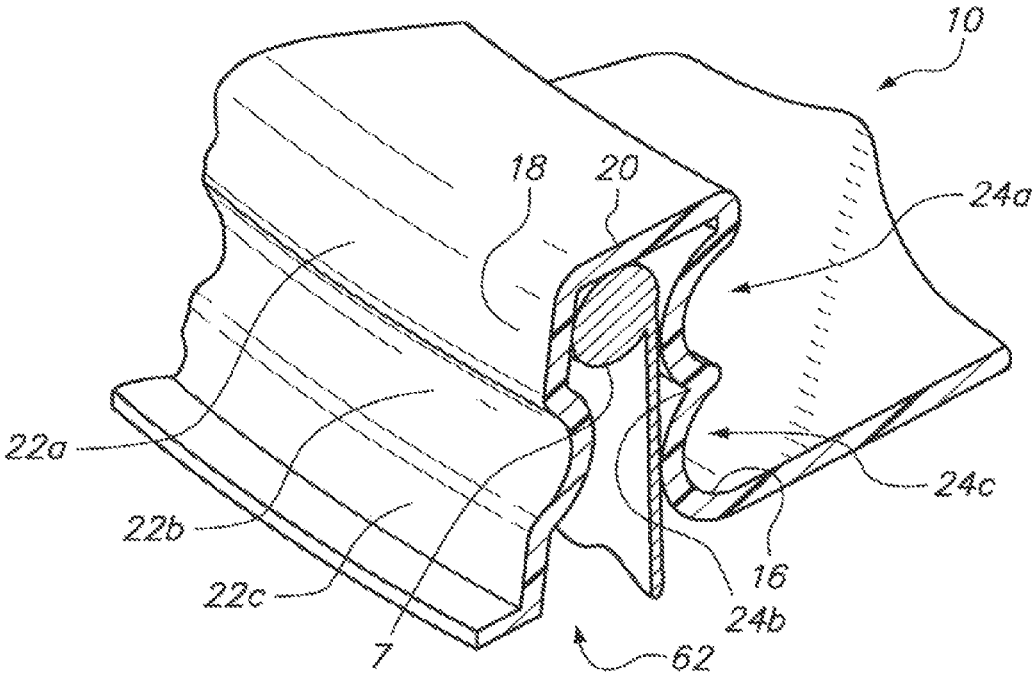
FIG. 10 shows a perspective cross sectional view of the annular outer side wall, the annular top wall and the annular inner side wall of the lid of the present invention in use with the brim of container.

Referring now to FIGS. 1, 5 and 10, rear side 36, first base member 38 and second base member 40 form a generally arcuate "C" shaped member. Rear side 36 and members 38 and 40 are complementary in size to a second beverage container's 5' annular wall's curvature 42'. In this manner, rear side 36, first base member 38 and the second base member 40 preferably form a vertical support surface for a second beverage container 5' to rest against. Rear side 36, first base member 38 and second base member 40 preferably support the second beverage container 5' in a horizontal and vertical direction in conjunction with the container closure 12. Thus, a user may stack a second beverage container 5' on a first beverage container 5.

Additionally, the lid 10 includes a circular channel 42 indented in the lid 10. Preferably, the channel 42 is formed from a stamping or molding operation on the container closure 12. The container closure 12 surrounds at least a segment of the circular indented channel 42. The channel 42 preferably adds no weight to the container closure 12 and acts as a stiffening member to ensure that the container closure 12 does not deflect or bend when subjected to the appropriate stress. Circular channel 42 preferable includes a rectangular shaped cross section and a depth of several millimeters. Channel 42 also provides for a stable stiff support structure for the lid 10 and ensures that when drinking the spout 26 and the lid 10 will withstand forces and stress imparted on the spout 26 and the lid 10. Channel 42 preferably allows fluid disposed on the top side of the lid 10 to collect therein and drain through aperture 6.

Figure 12:
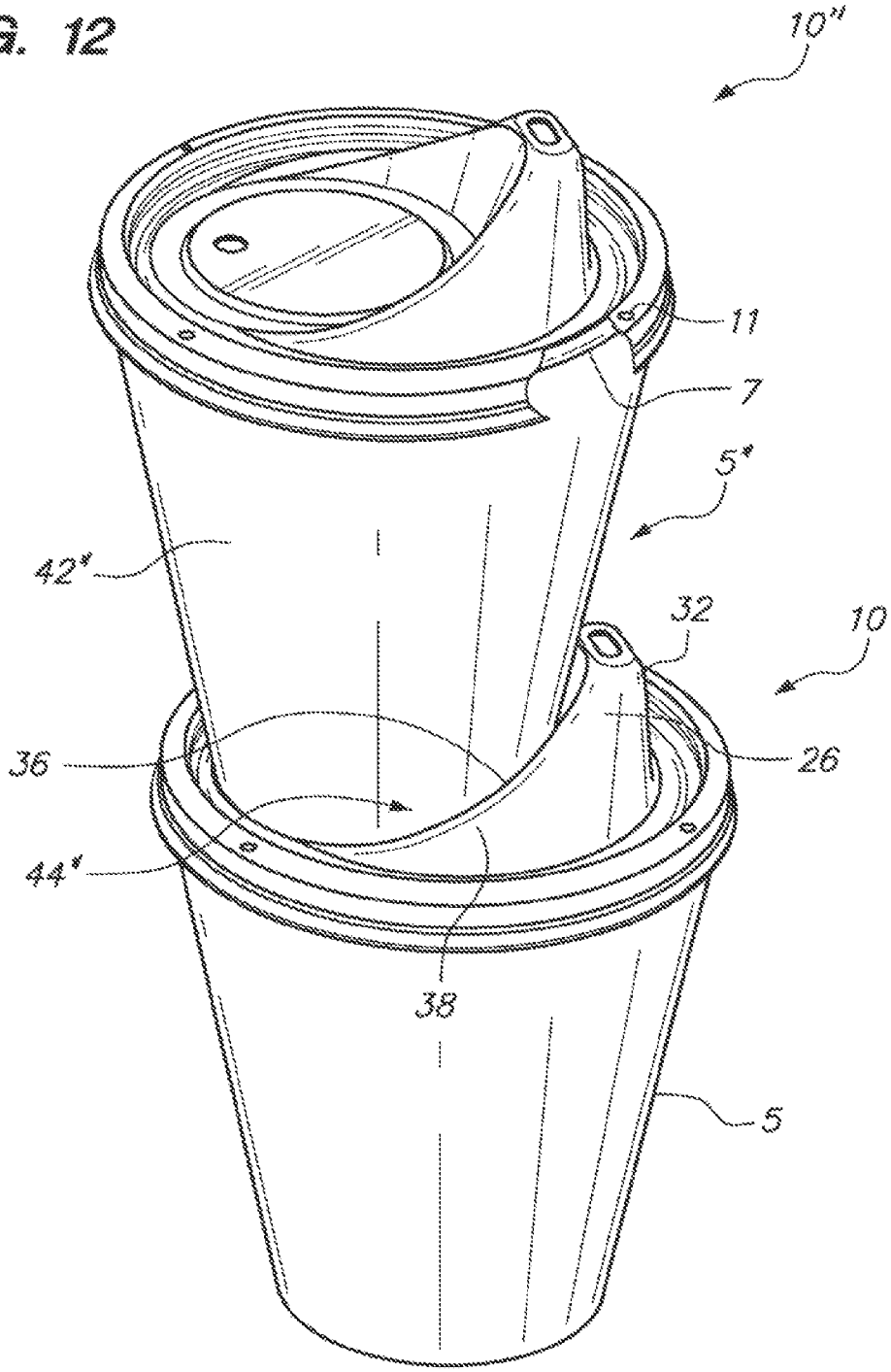
FIG. 12 shows a sipping spout including a rear surface to assist with supporting a second beverage container on a lid with the rear surface having a curvature that mates with the curvature of a second beverage container.

As shown in FIG. 12, the channel 42 preferably is about the same size and conforms to a bottom surface 44' of the second beverage container 5'. Bottom surface 44' engages with channel 42 to further support the second beverage container 5' on the lid 10.

In addition, channel 42 assists with stacking lid 10 with a second lid 10' as will be discussed herein. The channel 42 provides an additional guiding member, such that a second lid 10' having substantially the same pattern will engage with channel 42 and orient the container closure 12 to assist with stacking the container closure 12 on another lid 10'. Less preferably, the channel 42 may include a rounded cross section or include a differently shaped feature but conforms to a bottom 44' of a second beverage container 5' for stacking.

Turning now to FIG. 4, there is shown a side view of the spout 26 projecting upwards and extending from the container closure 12. As can be seen spout 26 is pronounced and includes a lateral surface 48, which is contiguous to the first base member 38. The spout 26 as shown in FIG. 4 is disposed away from a proximal portion 50 of the lid 10 by a distance d and extends from the container closure 12 by height h. This position is advantageous as the user does not have to attempt to fit the user's mouth around an aperture 34 that is disposed at the proximal portion 50.

Turning now to FIG. 5, there is shown a rear view of the sipping spout 26 according to the present disclosure with first and second base members 38 and 40 disposed on either side of top side 28. The top side 28 is generally shown as a flat member parallel to a top surface 29 of the base container portion 12. The top side 28 is integrally connected to base members 38 and 40 by the first and a second lateral surface, 48 and 52, which are contiguous to the top side 28. Preferably, the first and the second lateral surfaces 48 and 52 are angled to provide the wedged shaped appearance of the spout 26. In one non-limiting embodiment of the present disclosure, the angle can be anywhere from thirty to fifty degrees relative to axis 54, which is disposed perpendicular to the top surface 29 of the container closure 12.

Figure 6:
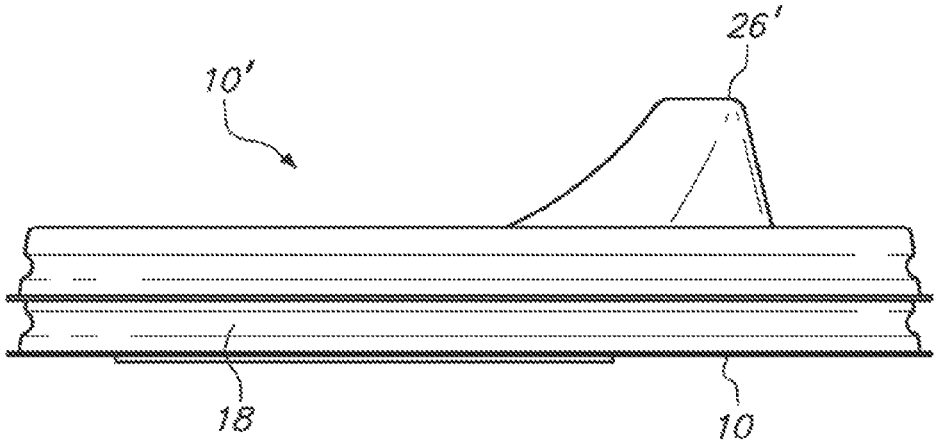
FIG. 6 shows a side view of the lid stacked on a second lid with a first sipping spout being stacked on a second sipping spout.

Turning now to FIGS. 4 and 6, there is shown a second lid 10' having a second spout 26' stacked on top of a lid 10 (shown in FIG. 6). In this aspect, spout 26 allows a second lid 10' having a second spout 26' to rest on the spout 26. For example, a lid 10' when stacked includes forces from gravity and also has considerations attributed to a poor support surface. If the angle is too great after several lids 10' are stacked on one another, the support surface on at least one lid 10' can be so misaligned that the lid 10' will experience sliding and may fall as attributed to a lack of horizontal support underneath the spout 26' and a poor support surface underneath the lid 10'.

The present lid 10 advantageously includes a spout 26 having a height h that engages with a second spout 26' from underneath the spout 26'. Height h provides for an arrangement whereby spout 26 permits stacking a predetermined number of lids 10 with decreased risk of the lids 10 falling under the stress of their combined weight. Height h provides a combined locking stacked composite of lids 10 and 10' wherein spout 26 provides support in the horizontal dimension that does not allow the second lid 10' to become misaligned and fall as lid 10' is grasped in the horizontal dimension. In this regard, spout 26 provides vertical and horizontal support to a second lid 10'.

Referring now to FIG. 7A, there is shown a bottom surface 56 of the lid 10. As can be seen the lid 10 includes a bottom surface 56 that is generally planar in shape and a bottom channel 58 that is formed underneath spout 26. The bottom channel 58 comprises a crescent shape wherein fluid is directed along channel wall 60 in the direction of reference arrows A and B to the aperture 34 of the spout 26. Bottom channel 58 preferably includes a nozzle shaped surface to direct fluid into the aperture 34 when the lid 10 is inverted in use.

Turning now to FIG. 7B, there is shown a cross sectional view of the spout 26 of FIG. 7A along line 7*b*-7*b* of FIG. 7A. Channel 58 is conformed to allow a second spout 26' of substantially identical size and shape (shown in FIG. 6) to engage with the channel 58. The spout 26 and channel wall 60 provide support to stack a number of lids 10 and 10' on top of one another (shown in FIG. 6).

Referring now to FIG. 10 there is shown a perspective cross sectional view of the annular outer side wall 18, the annular top wall 20 and the annular inner side wall 16 of the lid 10 of the present invention in use with the brim 7 of a container 5. Preferably, the annular inner wall 16, the annular outer wall 18 and the channel 62 provide the lid 10 with a primary sealing surface and a secondary sealing surface, which is advantageous. In this aspect the lid 10 mates and seals with the brim 7 in at least two different locations that are spaced from the top wall 20 of the lid 10. As can be seen, annular ribs 24*a*, 24*c* of the annular inner side wall and annular rib 22*b*, annular rib element 22*c* and annular channel 22*a* form a primary and secondary sealing surface to secure the brim 7 for a securely locked mating engagement therewith. Annular rib 22 of the annular outer side wall 18 forms a gripping area to secure the brim 7 for a securely locked mating engagement therewith.

Preferably, the lid 10 includes a primary sealing surface and a secondary sealing surface generally shown in FIGS. 9A and 10. Generally, the brim 7 engages first the primary sealing surface. Thereafter, brim 7 may then engage the secondary sealing surface to provide for a secondary sealing between the lid 10 and the container 5 at the brim 7. It should be appreciated that the lid 10, spout 26 and ribs 22, 24 may be configured to conform to secure to the dimensions of the brim 7 of a particular beverage container 5.

In this manner, ribs 24 of the inner side wall 16 engage the brim 7 on one side while rib channel 22*a* engage the brim 7 along the outer side wall 18. In a preferred embodiment, ribs 22*b*, 24*a,c* are spatially arranged to coordinate with one another. Preferably, rib element 22*c* of an exterior surface of the annular outer side wall 18 includes a flared portion that facilitates the brim 7 engaging with the channel 62. The flared portion of rib element 22*c* is annular and exaggerated in width relative to the top wall 20 as shown. In this manner, preferably rib element 22*c* acts as a guiding member.

In another embodiment, the lid 10 may include at least two primary sealing surfaces. In another embodiment, the lid 10 may include at least two secondary sealing surfaces. Various configurations are possible and within the scope of the present disclosure.

Figure 11A:
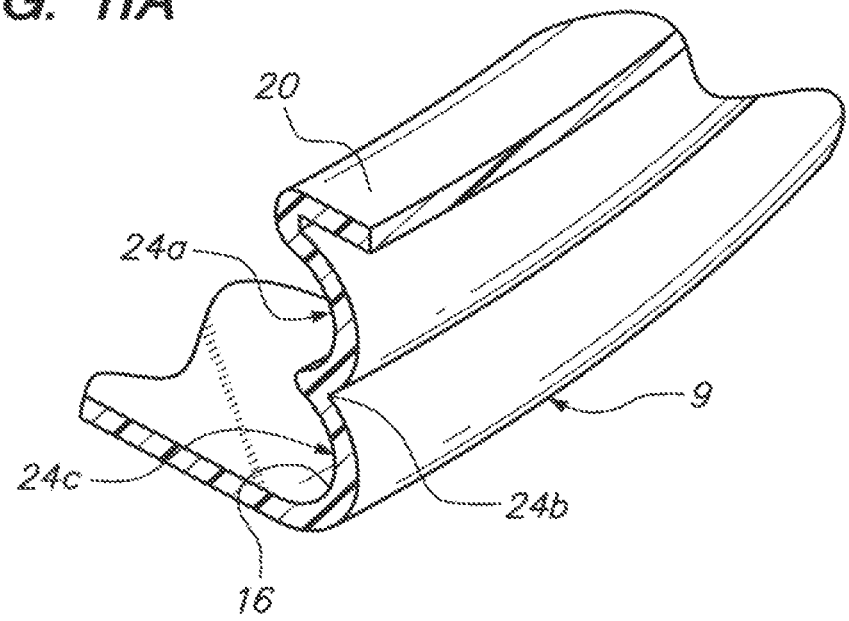
FIG. 11A shows a close up sectional view of the inner periphery of the annular inner side wall.

Referring to FIG. 11A, there is shown a close up sectional view of the inner periphery 16 of the annular inner side wall 16 illustrating a partial view of the annular ribs 24*a*, 24*c* along the inner side wall 16. Annular rib channel 24*b* is formed at a bottom of rib 24*a* and a top of rib 24*c* and is intermediate relative to 24*a* and 24*c*. In a preferred embodiment of the present invention, annular ribs 24*a* and 24*c* are parallel to one another and extend along the inner periphery 16 of the inner annular side wall 16 in a continuous ring with rib channel 24*b* therebetween.

Figure 11B:
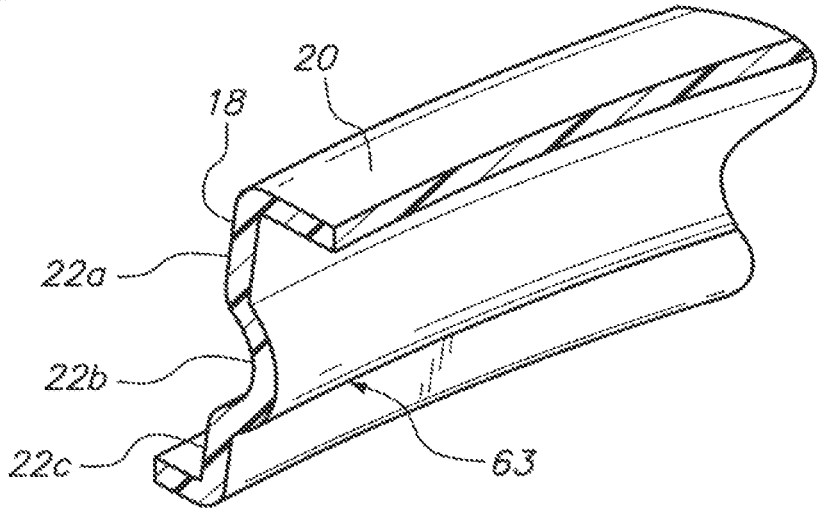
FIG. 11B shows a close up sectional view of the inner periphery of the annular outer side wall.

FIG. 11B shows a close up sectional view of the inner periphery 63 of the annular outer side wall 18 illustrating a partial view of annular rib 22*b*, annular rib element 22*c* and annular rib channel 22*a*. In a preferred embodiment of the present invention, annular rib element 22*c* is parallel to rib 22*b* and annular rib 22*b* extends along the inner periphery 63 of the annular outer side wall 18 in a continuous ring with rib channel 22*a* and rib element 22*c* disposed on either side of rib 22*b*.

Thus, while there have shown and described and pointed out fundamental novel features of the disclosure as applied to various specific embodiments thereof, it will be understood that various omissions and substitutions and changes in the form and details of the apparatus illustrated, and in their operation, may be made by those skilled in the art without departing from the spirit of the disclosure. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A container closure for a container comprising:

a disk shaped member including a circumferential rim extending about a periphery, the circumferential rim of the disk shaped member including an inner side wall, an outer side wall extending around the inner side wall, and a top wall interconnecting the inner side wall and the outer side wall;

an indentation in the outer side wall forming a first rib with a generally convex profile facing opposite to the inner side wall; and second and third ribs disposed along the inner side wall and each of the second and third ribs having a generally convex profile for providing leakage prevention and sealing of the container closure with the container, the second rib positioned proximate to a top portion of the inner side wall and the third rib positioned below the second rib when the container closure has the top wall in an uppermost orientation, the second and third ribs configured such that both seal against a flat inner surface of the container;

wherein the first rib is positioned higher than the third rib when the container closure has the top wall in an uppermost orientation, and wherein the sipping spout further comprises a first base member and a second base member, the first base member and the second base member forming a generally arcuate "C" shape for supporting a second container in a horizontal and vertical direction in conjunction with the container closure for stacking the second container on a first container.

2. The container closure of claim 1, wherein the top wall is generally perpendicular to both the outer side wall and the inner side wall.

3. The container closure of claim 1, wherein the top wall includes a plurality of spaced visual cues for viewing the brim of the container when the container closure is affixed to the brim, such that a position of the container closure with respect to the brim may be readily ascertained.

4. The container closure of claim 1, further comprising a circular indented channel in a top side of the container closure for receiving and engaging with a bottom of a second container.

5. The container closure of claim 1, wherein the outer side wall has a flared end positioned distal to the annular top wall.

6. The container closure of claim 1, further comprising a pronounced member projecting upwards and extending from the container closure, the pronounced member provides a sipping spout.

7. A lid for a container comprising:

a disk shaped member including a circumferential rim extending about a periphery, the circumferential rim of the disk shaped member including a annular inner side wall, a annular outer side wall extending around and opposite to the annular inner side wall, and an annular top wall interconnecting the annular outer side wall and annular inner side wall;

first and second ribs disposed in continuous rings parallel to one another on the annular inner side wall, the first and second ribs each facing opposite to the annular outer side wall with a generally convex profile for providing leakage prevention and sealing of the container closure with the container; and a third rib formed by an indentation into the annular outer side wall and having a generally convex profile facing opposite to the annular inner side wall, the third rib positioned higher than the second rib when the lid has the annular top wall in an uppermost orientation, wherein the sipping spout further comprises a first base member and a second base member, the first base member and the second base member forming a generally arcuate "C"shape for supporting a second container in a horizontal and vertical direction in conjunction with the container closure for stacking the second container on a first container.

8. The container closure of claim 7, wherein the annular top wall is generally perpendicular to both the annular outer side wall and the annular inner side wall.

9. The container closure of claim 7, wherein the annular top wall includes a plurality of spaced visual cues for viewing the brim of the container when the container closure is affixed to the brim, such that a position of the container closure with respect to the brim may be readily ascertained.

10. The container closure of claim 7, further comprising a circular indented channel in a top side of the container closure for receiving and engaging with a bottom of a second container.

11. The container closure of claim 7, wherein the annular outer side wall has flared end positioned distal to the annular top wall.

12. The container closure of claim 7, further comprising a pronounced member projecting upwards and extending from the container closure, the pronounced member provides a sipping spout.

13. A container closure for a container comprising:

a disk shaped member including a circumferential rim extending about a periphery, the circumferential rim of the disk shaped member including a annular inner side wall, a annular outer side wall surrounding the annular inner side wall, and an annular top wall interconnecting the annular outer side wall and annular inner side wall;

a first rib formed by an indentation in the annular outer side wall, the first rib includes a convex profile relative to the annular inner side wall, a second rib disposed along the annular inner side wall and facing opposite to the annular outer side wall with a generally convex profile, the container closure capable of securing a brim and a flat inner wall of the container between the first rib of the annular outer side wall and the second rib of the annular inner side wall; and a third rib formed in the annular inner side wall below the second annular rib opposite to the annular outer side wall when the lid has the annular top wall in an uppermost orientation, the first rib positioned higher than the third rib when the lid has the annular top wall in an uppermost orientation, wherein the second and third ribs are configured to provide leakage prevention and sealing of the container closure with the container, and wherein the sipping spout further comprises a first base member and a second base member, the first base member and the second base member forming a generally arcuate "C"shape for supporting a second container in a horizontal and vertical direction in conjunction with the container closure for stacking the second container on a first container.

14. The container closure of claim 13, wherein the annular top wall is generally perpendicular to both the annular outer side wall and the annular inner side wall.

15. The container closure of claim 13, wherein the annular top wall includes a plurality of spaced visual cues for viewing the brim of the container when the container closure is affixed to the brim such that a position of the container closure with respect to the brim may be readily ascertained.

16. The container closure of claim 15, further comprising a circular indented channel in a top side of the container closure for receiving and engaging with a bottom of a second container.

17. The container closure of claim 13, further comprising a pronounced member projecting upwards and extending from the container closure, the pronounced member provides a sipping spout.

* * * * *